United States Patent [19]

Berlese

[11] Patent Number: 4,679,335

[45] Date of Patent: Jul. 14, 1987

[54] VENTED BICYCLE SHOE

[76] Inventor: Remo Berlese, 31036 Ospedaletto di Istrana, Treviso, Italy

[21] Appl. No.: 790,109

[22] Filed: Oct. 22, 1985

[51] Int. Cl.[4] ..... A43B 5/14

[52] U.S. Cl. ..... 36/131; 36/3 B

[58] Field of Search ..... 36/3 R, 3 A, 3 B, 131, 36/113, 114, 25 R, 29

[56] References Cited

U.S. PATENT DOCUMENTS

| | | | |
|---|---|---|---|
| 3,952,428 | 4/1976 | Polsky | 36/131 |
| 4,078,321 | 3/1978 | Famolare, Jr. | 36/3 B |
| 4,361,972 | 12/1982 | Miller | 36/131 |
| 4,438,573 | 3/1984 | McBarron | 36/3 B |
| 4,445,284 | 5/1984 | Sakutori | 36/3 B |
| 4,523,393 | 6/1985 | Inohara | 36/3 B X |

FOREIGN PATENT DOCUMENTS

| | | | |
|---|---|---|---|
| 183678 | 3/1955 | Austria | 36/3 B |
| 579284 | 7/1959 | Canada | 36/3 B |
| 716762 | 8/1965 | Canada | 36/3 B |
| 2226216 | 5/1972 | Fed. Rep. of Germany | 36/3 B |
| 1109597 | 9/1955 | France | 36/3 B |
| 90327 | 11/1957 | Norway | 36/3 B |

*Primary Examiner*—Louis K. Rimrodt
*Assistant Examiner*—T. Graveline
*Attorney, Agent, or Firm*—Koppel & Harris

[57] ABSTRACT

A bicycle shoe is disclosed in which a plurality of spaced air scoops are located at the front of the shoe and aligned with channels formed in the inner base of the shoe and extending toward the heel. As the wearer moves rapidly forward on a bicycle, air is taken in through the scoops and distributed across the wearer's foot, producing a comfortable cooling action. The depths of the channels at their forward ends are preferably increased to provide the air scoops with greater intake areas, and the advantageous arrangements of the channels along the base of the shoe are disclosed.

8 Claims, 6 Drawing Figures

VENTED BICYCLE SHOE

BACKGROUND OF THE INVENTION

1. Field of the Invention

This invention relates to shoes for bicycle racing, and more particularly to bicycle shoes with an air vent capability.

2. Description of the Prior Art

Conventional bicycle racing shoes can become uncomfortably warm under race conditions, especially in hot weather. To date no practical way has been found to cool the interior of a bicycle shoe and make it more comfortable. While openings are sometimes provided on the bottom of the sole toward the front of the shoe, the purpose of such openings is to provide a water outlet for rainy weather and they are not effective in cooling the shoe for hot, dry conditions.

SUMMARY OF THE INVENTION

In view of the above problems associated with the prior art, the object of this invention is to provide a novel and improved bicycle shoe which has a positive ventilation action to cool the wearer's foot, and yet is comfortable and does not unduly complicate or increase the expense of the manufacturing operation.

These are other objects are accomplished by providing a bicycle shoe which has a bottom base section, and a plurality of spaced air scoops at the front of the shoe aligned with the base section. A plurality of spaced channels which vent to the interior of the shoe extend from the front of the shoe toward the rear along the base section from respective air scoops. The channels in the base section can either vent directly to the interior of the shoe, or a layer of cushioning material can be placed over the base section. The cushioning material either has slots aligned with the channels to complete a ventilation path, or is formed from a porous material through which the ventilating air can pass to the foot. Respective pairs of channels are preferably provided along the left and right sides of the base section, with the depths of the inner channels being greater than the depths of their respective outer channels.

The air scoops receive an intake of air when the wearer is moving forward on a bicycle, and transmit the incoming air to the channels and thereby to the wearer's foot. The air scoops are preferably formed from simple forward extensions of the channels, with the floors of the scoops canted downward to increase the air intake area and flow rate through the shoe. A positive inflow of ventilating air is thus established across the underside of the wearer's foot to produce a very comfortable cooling action, with the volumetric flow rate of incoming air varying with the speed of forward movement.

Other features and advantages of the invention will be apparent to those skilled in the art from the following detailed description of a preferred embodiment, taken together with the accompanying drawings, in which:

DETAILED DESCRIPTION OF A PREFERRED EMBODIMENT

Figure 1:
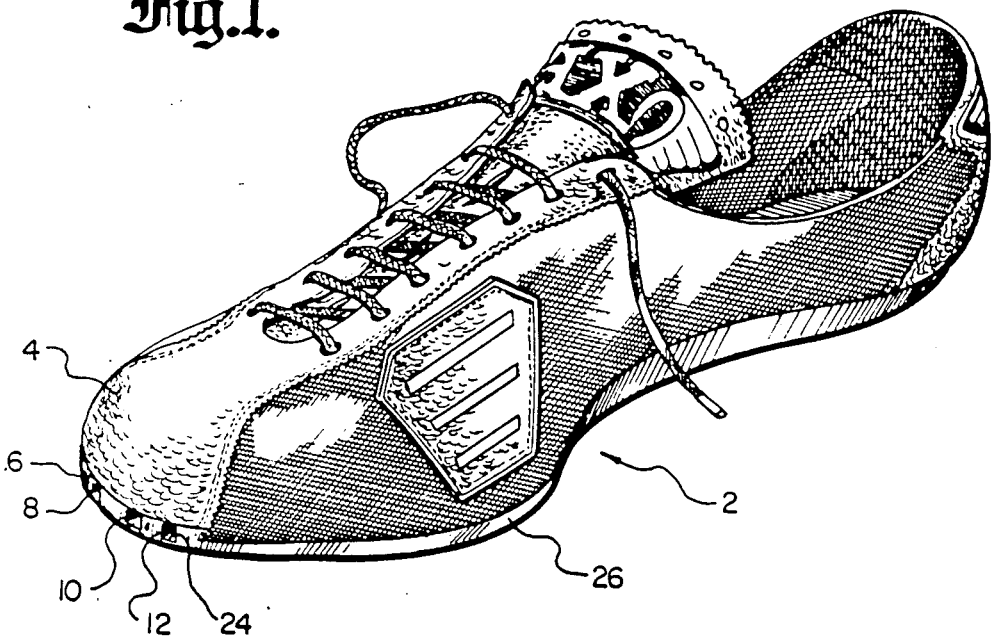
FIG. 1 is a perspective view of a bicycle shoe constructed in accordance with the invention.

Referring first to FIG. 1, the exterior of a bicycle shoe constructed in accordance with the invention is shown. The shoe includes a lower base section 2 which provides a sole, and an upper section 4 which is attached to the base section in a conventional manner. A plurality of air scoops 6, 8, 10 and 12 are formed in the base section at the front of the shoe to draw cooling air into the interior of the shoe as the wearer is moving rapidly forward on a bicycle. While four air scoops are shown, any convenient number could be used. Also, although various geometries could be molded into the base section to draw in a larger volume of air, such as expanding cone-like structures, a simple construction such as the provision of channels in the base section with generally rectangular cross-sections will provide an adequate flow of air.

Figure 2:
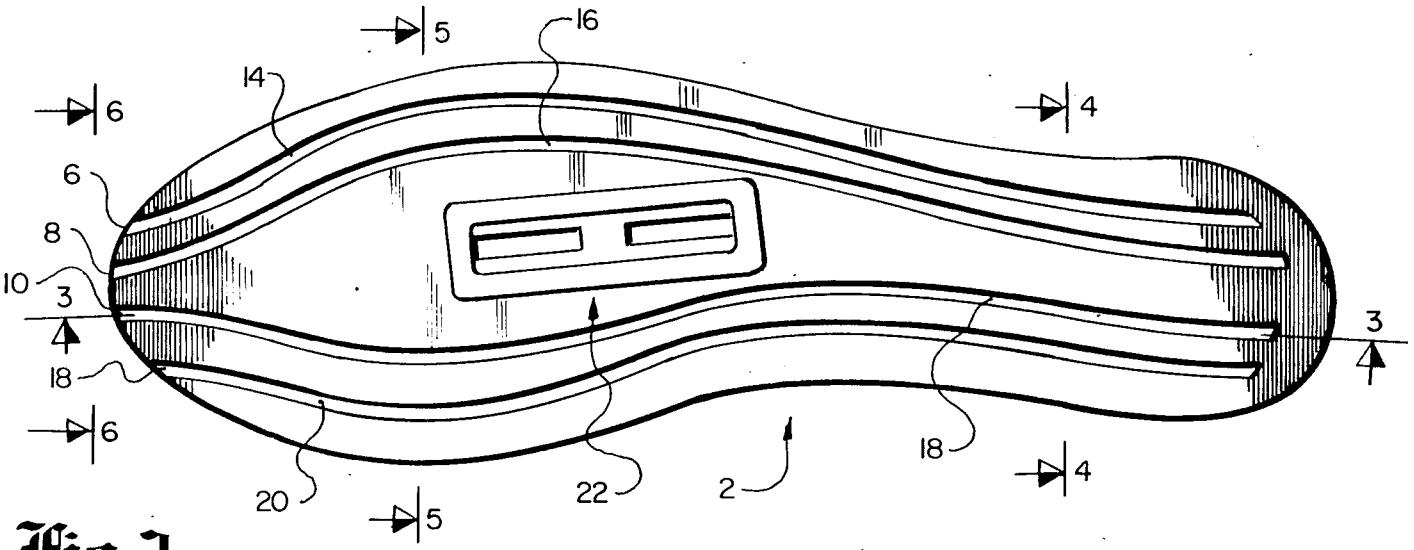
FIG. 2 is a plan view showing the interior of the base section used in the shoe.

Referring now to FIG. 2, a plurality of spaced channels 14, 16, 18 and 20 are shown extending along the upper interior portion of the base section from respective air scoops at the front of the shoe towards the rear. In this embodiment one pair of channels runs along the right side of the shoe and another pair along the left side, with each of the channels terminating towards the rear of the heel. The base section is formed from a molded plastic, and the combined channels and air scoops are conveniently formed by simple adding appropriate inserts to the mold. The channel widths are approximately 2.5–4 mm., but greater or lesser dimensions can be used if desired. A slotted section 22 is provided at the center of the base section to enable the shoe to be secured to a pedal attachment block in a conventional manner.

Figure 4:
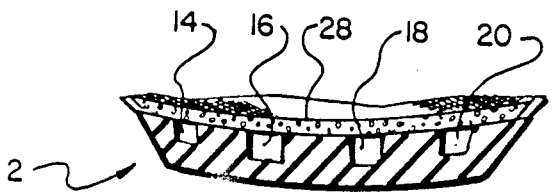
FIGS. 3, 4 and 5 are sectional views taken along the lines 3—3, 4—4, and 5—5 of FIG. 2, respectively.
Figure 5:
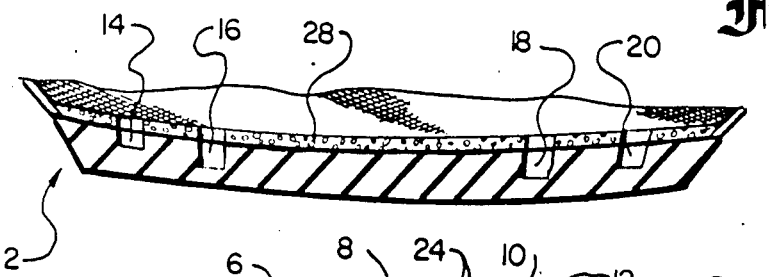
Figure 3:
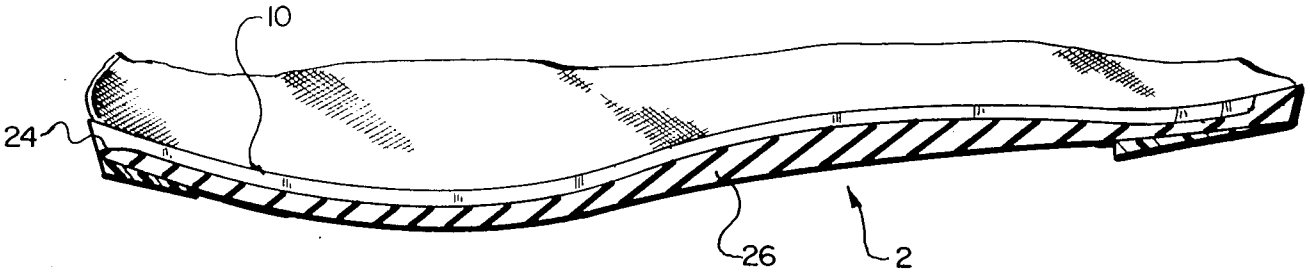

Referring now to FIGS. 3–5, it can be seen that each of the channels has a substantially uniform depth from front to rear, except at the very forward end of the channel 24 which defines the air scoop. At this location the bottom walls of the channels are canted downward to increase the channel depth, thereby presenting a greater area for the intake of air and a correspondingly increased velocity of air flow through the channels.

It has also been found that an enhanced cooling action can be achieved for a common-sized air scoop by making the laterally outer channels 14 and 20 shallower than the inner channels 16 and 18. The outer channels may be approximately 2 mm. deep, and the inner channels approximately 4 mm.

Figure 6:
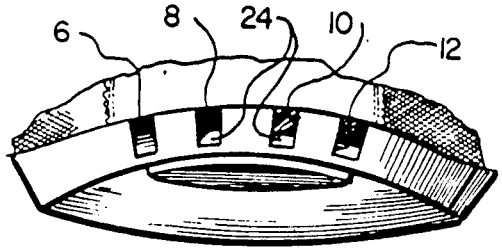
FIG. 6 is a front elevational view of the base section.

The base section 2 comprises a unitary molded form 26, as shown in FIG. 3, which preferably has a laminated leather top with corresponding channels, or a layer of cushioning material 28 can surmount the form 26 as shown in FIGS. 4 and 5. The cushioning material is formed from a closed cell foam which is porous and transmits an air flow from the underlying channels to the wearer's foot, or the cushioning layer can itself have slots formed in registration with the channels as shown in FIG. 5. The extended channel depth which establishes the air scoops at the front of the shoe is shown in FIG. 6.

In operation, the described shoes provide a positive venting action to cool the foot and give an added degree of comfort when the wearer is riding forward on a bicycle. The rapid forward motion of the shoe draws a flow of air into each of the scoops 6, 8, 10 and 12, which air intake is transmitted along the length of the respective channels 14, 16, 18 and 20. This air flow is transmitted upward from the channels to the underside of the wearer's foot, and eventually exhausts from the shoe principally around the ankle area. A cooling and continuous air flow is thus provided inside the shoe which considerably enhances the wearer's comfort.

While particular embodiments of the invention have been shown and described, numerous modifications and alternate embodiments will occur to those skilled in the art. Accordingly, it is intended that the invention be limited only in terms of the appended claims.

I claim:

1. A bicycle shoe, comprising:

a base section having an exterior portion for engaging a bicycle pedal and an interior portion bearing the underside of the wearer's foot, an upper section attached to the base section and enclosing the wearer's foot, a plurality of spaced air scoops at the front of the shoe aligned with the base section, the air scoops being adapted to receive an intake of air in response to forward motion of the shoe, and a plurality of spaced channels extending along the interior portion of the base section from respective air scoops at the front of the shoe toward the rear of the shoe, said channels venting to the interior of the shoe, the air scoops comprising the forward ends of respective channels, and the depths of the channels being increased at their forward ends to provide the air scoops with greater intake areas than the channels, and thereby increase the flow rate of air through the channels.

2. The bicycle shoe of claim 1 said base section comprising a layer of support material surmounted by a layer of porous cushioning material, said channels being formed in the support material and venting to the cushioning material.

3. The bicycle shoe of claim 2, wherein the support material is a molded plastic and the cushioning material is a closed cell foam.

4. The bicycle shoe of claim 1, said base section comprising a layer of support material surmounted by a layer of cushioning material, said channels being formed in the support material, and said layer of cushioning material having slots therein aligned with the channels.

5. The bicycle shoe of claim 1, said base section comprising a layer of molded plastic, said channels extending down from the upper surface of the plastic and venting directly to the interior of the shoe.

6. The bicycle shoe of claim 1, said channels extending continuously from the front of the shoe to the heel.

7. The bicycle shoe of claim 1, the channel widths being in the approximate range of 2.5–4 mm.

8. A bicycle shoe, comprising:

a base section having an exterior portion for engaging a bicycle pedal and an interior portion bearing the underside of the wearer's foot.

a plurality of spaced air scoops at the front of the shoe aligned with the base section, the air scoops being adapted to receive an intake of air in response to forward motion of the shoe, and a plurality of spaced channels extending along the interior portion of the base section from respective air scoops at the front of the shoe toward the rear of the shoe, said channels venting to the interior of the shoe, respective pairs of channels being provided along the left and right sides of the base section, each pair of channels including a laterally outer channel and a laterally inner channel, the depths of the inner channels being greater than the depths of their respective outer channels.

* * * * *